United States Patent [19]

Sakaida et al.

[11] Patent Number: 4,571,101

[45] Date of Patent: Feb. 18, 1986

[54] PRINT HEAD

[75] Inventors: Atsuo Sakaida, Gifu; Masafumi Kawaura, Nagoya; Yasuji Chikaoka, Shippocho; Hiroshi Iwata, Nagoya; Kiyomitsu Asano, Musashino, all of Japan

[73] Assignees: Brother Industries, Ltd.; Nippon Telecommunication Engineering Company, both of Japan

[21] Appl. No.: 662,725

[22] Filed: Oct. 19, 1984

[30] Foreign Application Priority Data

Oct. 20, 1983 [JP] Japan ..... 58-163206[U]
Oct. 20, 1983 [JP] Japan ..... 58-163207[U]

[51] Int. Cl.[4] ..... B41J 3/12

[52] U.S. Cl. ..... 400/124; 400/719; 335/300

[58] Field of Search ..... 400/124, 719; 101/93.04, 93.05; 98/78; 312/236; 335/300

[56] References Cited

U.S. PATENT DOCUMENTS 2,183,402 12/1939 Kepple ..... 98/78 X
3,347,147 10/1967 Howard ..... 98/78

FOREIGN PATENT DOCUMENTS 89963 7/1981 Japan ..... 400/124
164483 12/1981 Japan ..... 400/719
131073 8/1983 Japan ..... 400/124

*Primary Examiner*—Paul T. Sewell
*Attorney, Agent, or Firm*—Kane, Dalsimer, Kane, Sullivan and Kurucz

[57] ABSTRACT

A print head for impact type dot matrix printer having means for air-cooling the interior of the print head elevated in temperature due to the generation of heat of solenoid coils, the air cooling means is constituted in such a manner that the outer face of the print head along the direction of movement thereof is formed so as to cause the faster flow of air along said outer face when the print head is moved, and said outer face is provided with ventilating hole means which communicates the interior of the print head and the outside. When the print head is moved, it causes the faster flow along said outer face to thereby draw the air from the interior of the print head through the ventilating hole means due to the difference in pressure.

1 Claim, 11 Drawing Figures

PRINT HEAD

BACKGROUND OF THE INVENTION

This invention relates to a print head mounted in an impact type dot matrix printer, and more particularly to an air cooling means for the interior of the print head.

In a conventional print head, when each solenoid mounted within the print head has been energized, each of armatures having a printing wire is swung to perform the printing operation with the end of the printing wire. However the generation of heat in the solenoid caused the temperature within the print head to rise, which in turn increased the electrical resistance of coils, so that the driving properties of the solenoids was reduced and therefore performance was deteriorated. In order to release such heat, the print head in the prior art had numerous cooling fins attached to the side face thereof, which resulted in a larger size and heavier weight of the print head. This further required a wider space for a printer to mount the print head therein and resulted in a larger-sized apparatus, and hence it was difficult to move the print head in reciprocating motion at a higher speed and smoothly, thus making the printing operation at a higher speed impossible. There is also known a print head in which a cooling fan is mounted to cool solenoids by the air introduced into the printing head. However such print head also was larger in size and heavier in weight.

SUMMARY OF THE INVENTION

It is therefore to provide a print head which is reduced in number of parts and in weight, and which ensures effective cooling of the interior of the print head to thereby improve the performance of response of the armatures.

According to the invention, there is provided a print head, wherein the outer face of the print head along the direction of movement thereof is formed so as to cause the faster flow of air along said outer face when the print head is moved, and said outer face is provided with ventilating hole means which communicates the interior of the print head and the outside. With the construction above, the air elevated in temperature within the print head may be discharged through the ventilating means out of the print head due to the difference in pressure.

Other objects and aspects of the invention will become apparent from the following description of embodiments with reference to the accompanying drawings.

DETAILED DESCRIPTION OF THE PREFERRED EMBODIMENTS:

The first embodiment of the invention will be explained with reference to FIGS. 1 to 6.

Figure 1:
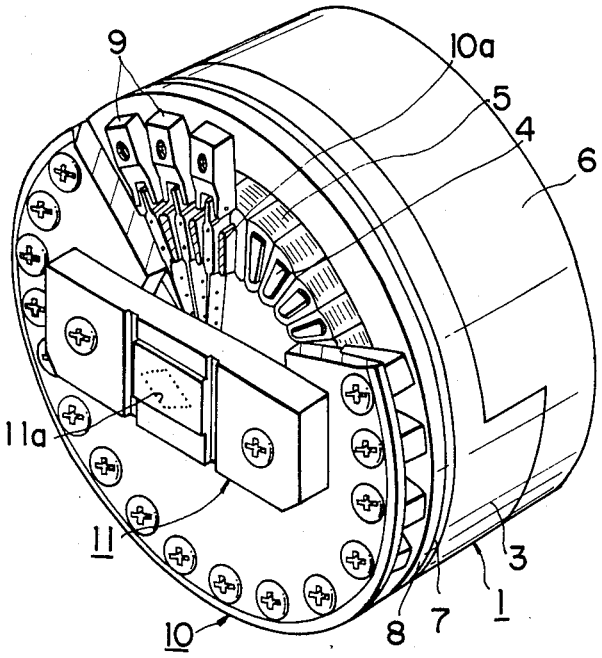
FIG. 1 is a perspective view, with parts partially broken away, of a print head of the first embodiment of the invention.
Figure 2:
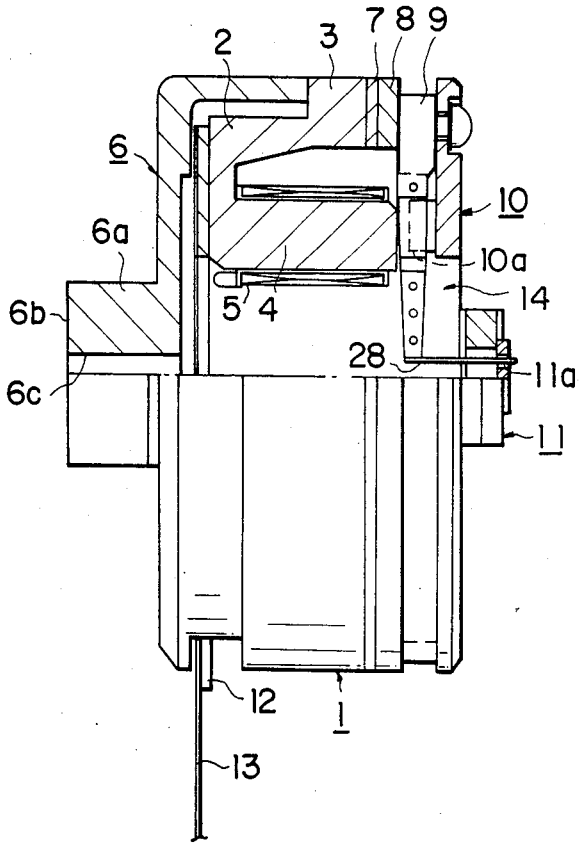
FIG. 2 is a schematic sectional view of the print head in FIG. 1.

As shown in FIGS. 1 and 2, a yoke member 1 which constitutes a magnetic circuit is formed of Co.Fe alloy called "Permendur" having a property of highly saturated magnetic flux density, and consists of a substantially cylindrical outer yoke 3 and an inner yoke 2 located in spaced relation to the outer yoke 3 and having numerous comb-like portions 4 formed integrally on the same circumference at suitable pitches. Solenoid coils 5 are wound round the comb-like portions 4 to constitute an electromagnetic device. A rear casing 6 is glued to the rear side of the outer yoke 3, and an annular permanent magnet 7 and a holding member 8 are glued to the front side of the outer yoke 3. On the other hand, a plurality of actuators 9 are each secured by screws to the end portion at the outer peripheral side of the rear face of a front yoke 10 in radially corresponding relation to each of the comb-like portions 4. The front yoke 10 with each of the actuators 9 secured thereto by screws is located relative to the holding member 8 by pins (not shown) projecting from the holding member 8, and each of the actuators 9 is magnetically attracted on the member 8 by magnetic force of the permanent magnet 7. A plurality of projections 10*a* extending between armatures 21 to be explained later are each integrally formed on the rear face of the front yoke 10 to form a magnetic circuit leading to the actuator 9 and the yoke 4. A circular opening 14 is formed in the central portion of the front yoke 10, and a rectangular guide 11 having numerous guide holes 11*a* arranged in the form of rhomb is mounted on the front side of the front yoke 10, and serves to guide slidably the end portion at the printing side of each of printing wires 28 bonded by brazing to the free end of the actuators 9 and extending substantially linearly. The opening 14 is constituted with the guide 11 attached thereto such that the opening 14 communicates with the interior of the print head and allows to introduce the air therein. Further, the electrical lead end of each of the solenoid coils 5 wound round the comb-like portions 4 is soldered on a flexible cable 13 attached to a base plate 12. The electrical wire of the flexible cable 13 is connected to a solenoid driving means (not shown) within the printer proper, whereby exciting current is selectively supplied to each of the solenoid coils 5.

Figure 4:
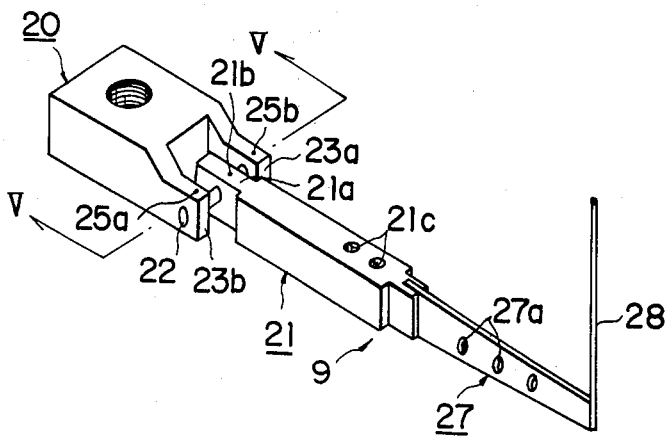
FIG. 4 is a perspective view of an actuator mounted in the print head.
Figure 5:
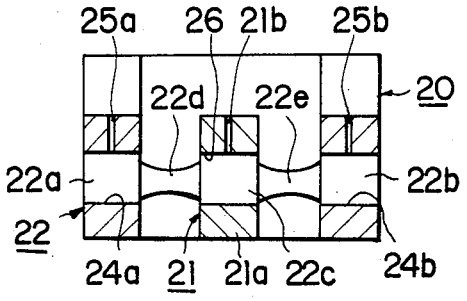
FIG. 5 is a sectional view taken along the line V—V of FIG. 4.

Referring to FIGS. 4 and 5, each of the actuators 9 comprises a holder 20, an armature 21 arranged in opposed relation to the yoke 4, a torsion spring 22 which supports the armature 21 for swinging movement relative to the holder 20, and a wire holder 27. The holder 20 is fixedly secured at its base end to the end portion at the outer peripheral side of the rear face of the front yoke 10, and is formed at its top end portion with bifurcated portions 23*a*, 23*b*. These bifurcated portions 23*a*, 23*b* are provided with through-holes 24*a*, 24*b*, into which both axial end portions of the torsion spring 22 are fitted and fixed. Further, these bifurcated portions 23*a*, 23*b* are formed with holes 25*a*, 25*b* for solder material communicating with the through-holes 24*a*, 24*b*, and these solder holes are filled with solder material such as palladium solder, silver solder, gold solder or the like in the form of pellet or rod when bonding the holder 20 to the torsion spring 22 by brazing.

Each of the armatures is constructed of Co.Fe alloy called "Permendur" having a property of highly saturated magnetic flux and constitutes a magnetic circuit together with the comb-like portion 4 and the projection 10*a*. The armature 21 is formed with a through-hole 26 at the opposite end portion 21*a* positioned between the bifurcated portions 23*a* and 23*b*, into which the axial central portion of the torsion spring 22 is fitted and fixed by brazing. Further, a wire holder 27 is bonded by brazing to the top end portion of the armature 21. A printing wire 28 shaped in tapered form from the end at the printing side to the base end is bonded by brazing to the top end portion of the wire holder 27. The armature 21 is also formed at the opposite end portion 21*a* with solder hole 21*b* communicating with the through-hole 26, and the solder hole 21*b* is filled with solder material when bonding the armature 21 and the bifurcated portion 23*a*, 23*b* by brazing. The armature 21 is formed at its front end side with drill holes 21*c*, which eliminates excessive material portions unnecessary for the magnetic circuit leading to the projection 10*a* to thereby reduce the mass. Further, the wire holder 27 is also formed with holes 27*a* to reduce the mass.

The above-mentioned torsion springs are made of maraging steel consisting of high nickel steel containing extremely low carbon, or JIS (Japanese Industrial Standard) 15-7 PH, 17-7 PH stainless steel of percipitation hardening type martensite system. The torsion spring 22 is formed with larger diameter portions 22*a*-22*c* at both the end portions and the central portions in the axial direction which are fitted into and fixed to the inner walls of the through holes 24*a*, 24*b* and 26 by brazing. Moreover, the intermediate portions 22*d*, 22*e* interposed between these large diameter portions 22*a*-22*c* are formed in the concave section such that they become progressively greater in diameter with the approach to the larger diameter portions 22*a*-22*c*. This makes it difficult for torsional stress actuating at the time of printing operation to concentrate in the boundary portions between the larger diameter portions 22*a*-22*c* and the intermediate portions 22*d*, 22*e*.

The construction as described above does not constitute part of the invention. Now, air cooling means of the print head according to the invention will be explained below.

Figure 3A:
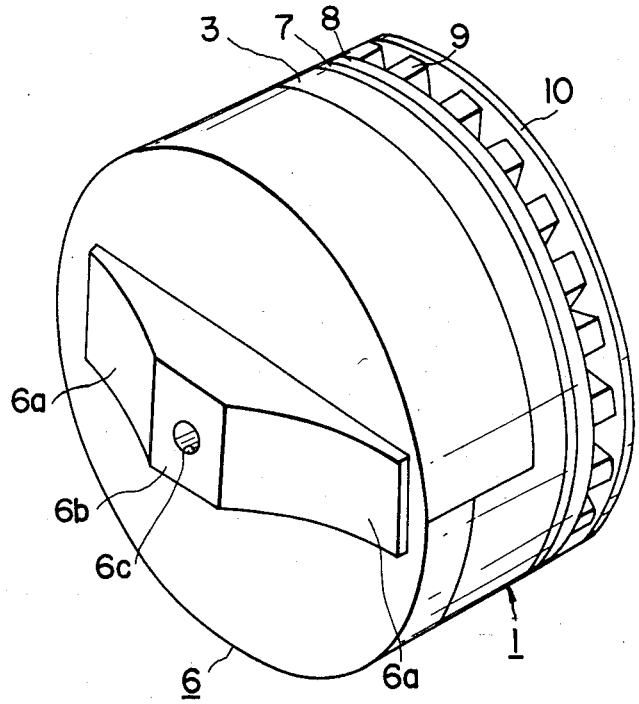
FIG. 3(A) is a perspective view illustrating the rear side of the print head.
Figure 3B:
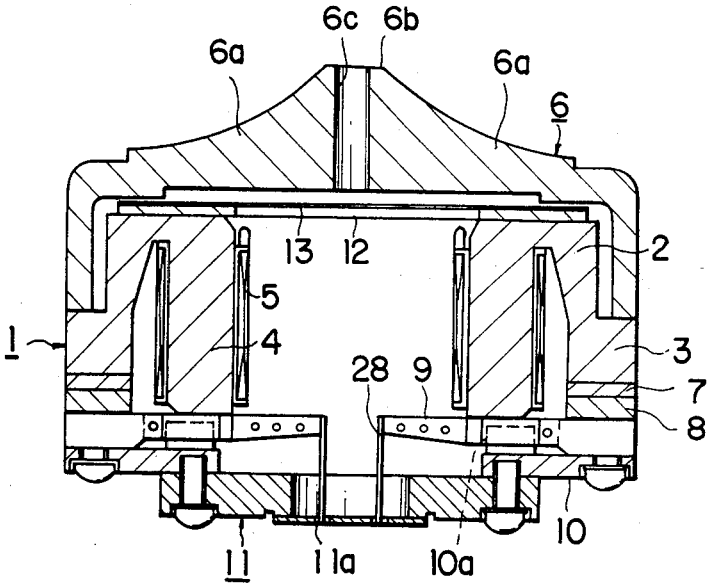
FIG. 3(B) is a schematic sectional view of the print head.

As shown in FIGS. 3 (A) and (B), the rear face of the rear casing 6 constitutes an outer face along the direction of movement of the print head. Formed integrally on the rear face of the rear casing according to the invention to cause the faster flow of air along the direction of movement of the print head is a projecting portion 6 which increases progressively in amount of projection in the direction of movement of the print head as shown with arrow marks of full lines. And, the projecting portion 6 is formed at its top portion 6*b* with a ventilating hole 6*c* which communicates with the interior of the print head.

Figure 6:
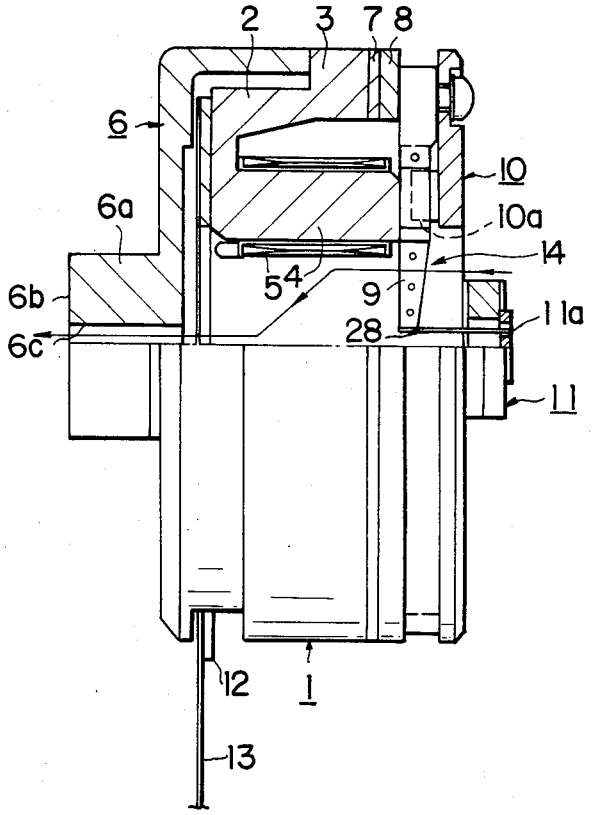
FIG. 6 is a fragmentary sectional view of the print head showing a state in which the cooling operation is effected by the air.

The operation of the air cooling means of the print head according to the invention will be explained below. In FIG. 6, assuming that the rear face of the rear casing 6 is kept at a suitable distance from the wall face of the body frame 30 (not shown), when the print head is moved in reciprocating motion along said wall face, the speed of flow of the air passing the top portion 6*b* of the projecting portion 6 is higher than that at the other portion 6*a* of the projecting portion 6 due to the fact that the sectional area of the space through which the print head runs is the minimum at the top portion 6*b*. With such higher speed, the pressure at the top portion 6*b* becomes lower than that at the other portions, and the air which has been introduced through the opening 14 and increased in temperature due to the generation of heat in the solenoid coil 5 with the printing operation, is discharged through the ventilating hole 6*c* out of the print head because of the above-mentioned difference in pressure. On the other hand, with the discharge of the warm air, the cold air is introduced through the opening 14. As a result, the flow of the air as shown in the arrow marks of the full lines in FIG. 6 is produced, whereby rise in temperature within the print head can be prevented.

Figure 7:
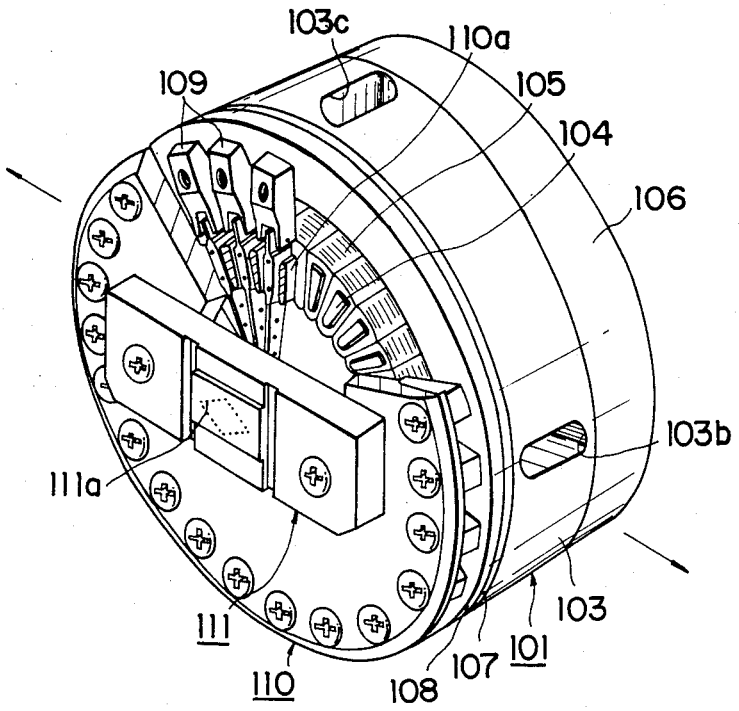
FIG. 7 is a perspective view, with parts partially broken away, of a print head of the second embodiment of the invention.
Figure 8:
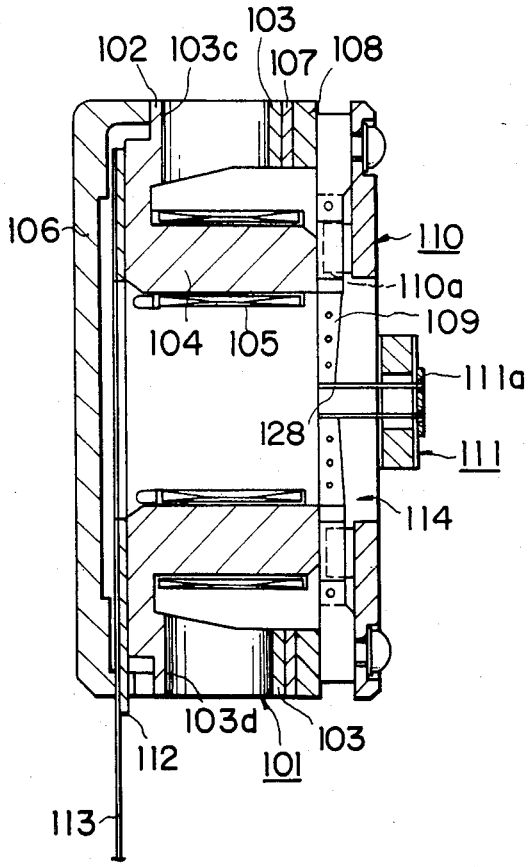
FIG. 8 is a fragmentary vertical sectional view of the print head in FIG. 7.
Figure 9:
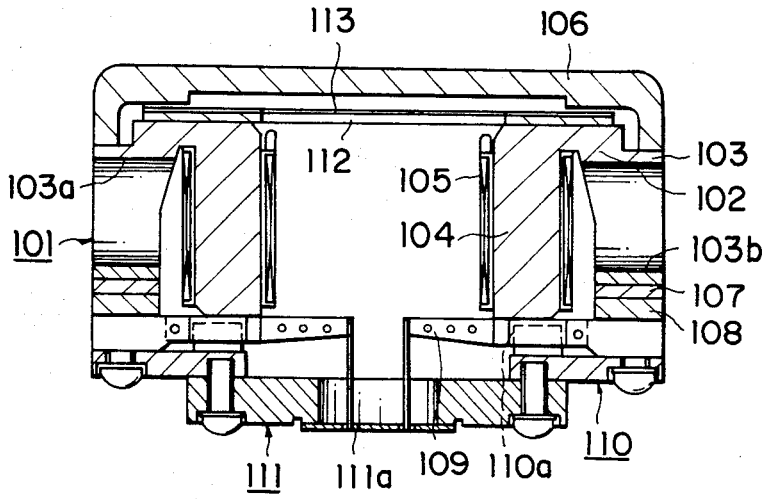
FIG. 9 is a fragmentary sectional view of the print head in FIG. 7.
Figure 10:
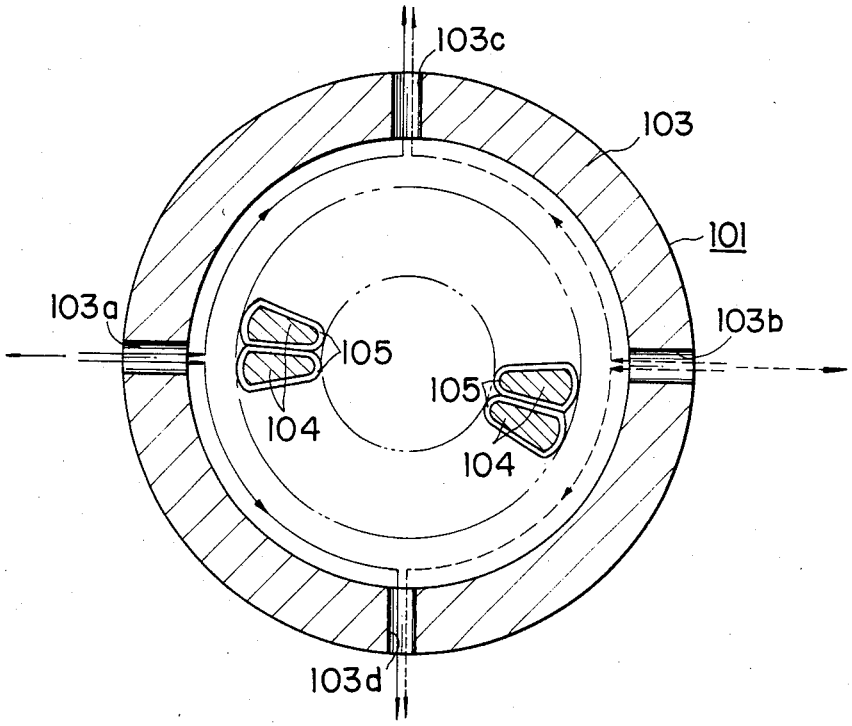
FIG. 10 is a cross-sectional view of an outer yoke containing therein comb-like portions with solenoid coils illustrating a state in which the cooling operation is effected by the air.

Now, the second embodiment of cooling means of the print head according to the invention will be explained below with reference to FIGS. 7-10. As best seen in FIGS. 7 and 10, according to the invention an outer yoke 103 is provided with ventilating holes 103*a*, 103*b* and 103*c*, 103*d* at either left and right side faces facing the direction of movement of the print head and at the upper and lower side faces which constitute the outer faces along the direction of movement of the print head, respectively.

The operation of the second embodiment will be explained below. In FIG. 10, when the print head is moved in the direction of arrow mark of full line, the air is introduced with movement of the print head into the interior of the print head through the ventilating hole 103*a* provided at the side faces of the outer yoke 103 toward the direction of movement of the print head. Due to the face that the space through which the print head runs is the minimum in sectional area at the top and bottom sides of the outer yoke 3, the flows of the air passing the top and bottom sides of the outer yoke 3 become faster than those of the air passing the other portions, whereby the top and bottom sides become lower in pressure than the other portions. Accordingly, the air which has been introduced through the ventilating holes 103*a*, flowing as shown with arrow marks of full lines and increased in temperature due to the generation of heat of the solenoids 105 with the printing operation, is discharged through the ventilating holes 103*c*, 103*d* out of the print head because of the above-mentioned difference in pressure. As a result, the flows of the air are produced as shown with arrow marks of full lines in FIG. 6, whereby rise in temperature within the print head can be prevented. Further, when the print head is moved in the direction of arrow marks of dotted line in FIG. 6, the air which has been introduced through the ventilating holes 103*b* with movement of the print head, flowing as shown with dotted lines in FIG. 6 and increased in temperature due to the generation of heat of the solenoid coils 105, is discharged through the ventilating holes 103*c*, 103*d* out of the print head.

In the print head according to the invention, the difference in pressure between the outer face of the print head along the direction of movement thereof and other portions of the same causes the warm air within the print head to be discharged out of the print head, so that rise in temperature within the print head is prevented and the deterioration of driving properties of the solenoids is also prevented.

What is claimed is:

1. A print head for movement in a preselected direction comprising:

a cylindrical yoke member (1);

a front wall portion positioned so as to cover one of the end faces of said cylindrical yoke member;

a rear wall portion positioned so as to cover the other of the end faces of said cylindrical yoke member;

comb-like portions (4) arranged in annular form inside said cylindrical yoke member;

a plurality of coils (5) each wound around each of said comb-like portions and forming a space therebetween;

a plurality of armatures (21) each arranged in opposite relation to each of said comb-like portions;

a plurality of printing wire (28) each connected at one end to each of said armatures and at the other end projecting outwardly from the front wall portion;

said print head being provided with a suction hole (14) such that it opens outwardly at said front wall and communicates with said space; and said rear wall being formed with a projection portion (6) which increases progressively in amount of projection in the direction of movement of the print head terminating in an extreme end, said projection portion being provided with a discharge hole (6C) opening at said extreme end and communicating with said space said discharge hole being positioned at a low pressure region with respect to air pressure at said suction hole, said low pressure region being generated by the movement of the print head to form a cooling air stream through said suction hole and said space.

* * * * *